US008246214B2

(12) United States Patent
Huang et al.

(10) Patent No.: US 8,246,214 B2
(45) Date of Patent: Aug. 21, 2012

(54) LAMP HOLDER

(76) Inventors: Kun-Ming Huang, Kaohsiung (TW); Wei-Chih Hsu, Kaohsiung (TW)

( * ) Notice: Subject to any disclaimer, the term of this patent is extended or adjusted under 35 U.S.C. 154(b) by 362 days.

(21) Appl. No.: 12/749,038

(22) Filed: Mar. 29, 2010

(65) Prior Publication Data

US 2011/0214849 A1 Sep. 8, 2011

(30) Foreign Application Priority Data

Mar. 4, 2010 (TW) ..... 99106270 A

(51) Int. Cl.
*F21V 29/00* (2006.01)

(52) U.S. Cl. ..... 362/294; 165/185; 362/373; 362/646; 362/659

(58) Field of Classification Search ..... 165/185; 362/218, 249.02, 294, 373, 547, 646, 659
See application file for complete search history.

(56) References Cited

U.S. PATENT DOCUMENTS

| | | | | |
|---|---|---|---|---|
| 4,704,669 | A | 11/1987 | Brunner | |
| 6,824,293 | B2 | 11/2004 | Chang | |
| 7,517,124 | B2 | 4/2009 | Josquin et al. | |
| 7,771,082 | B2 * | 8/2010 | Peng et al. | 362/294 |
| 8,092,045 | B2 * | 1/2012 | Xiao et al. | 362/294 |

* cited by examiner

*Primary Examiner* — Stephen F Husar
(74) *Attorney, Agent, or Firm* — Muncy, Geissler, Olds & Lowe, PLLC

(57) ABSTRACT

A lamp holder includes a heat dissipating seat having a compartment. A substrate is mounted in the compartment of the heat dissipating seat. The substrate includes a control circuit and at least one slot. At least one lighting element is mounted in the at least one slot and in electrical connection with the control circuit. The substrate further includes two flexible terminals in electrical connection with the control circuit and the at least one slot. When mounting the lamp holder into a space of a base, the flexible terminals are inserted into two coupling holes in a conductive portion of an inner periphery of the space. The heat dissipating seat is then pressed downward so that the resiliency of the flexible terminals urges the heat dissipating seat into the space of the base, providing easy assembly.

11 Claims, 8 Drawing Sheets

LAMP HOLDER

BACKGROUND OF THE INVENTION

1. Field of the Invention

The present invention relates to a lamp holder and, more particularly, to a lamp holder that can effectively dissipate heat generated by a lighting element held thereby and that can be easily assembled.

2. Description of the Related Art

FIG. 1 illustrates a conventional lamp 8 including a base 80 having a conductive portion 81 and defining a space 83. A halogen bulb 82 is received in the space 83 and directly coupled to the conductive portion 81. Since the halogen bulb 82 generates high heat during use, the lamp 8 includes a cover 84 to avoid touch to the halogen bulb 82, to avoid fire resulting from contact between the halogen bulb 82 and an inflammable object, to prevent damage to the halogen bulb 82 by impact, and to provide an aesthetically pleasing appearance. Although the cover 84 includes a plurality of opening 85 for dissipating the heat generated by the halogen bulb 82, the heat dissipating effect is not satisfactory.

FIG. 2 illustrates another conventional lamp 9 including a base 90 having a conductive portion 91 and defining a space 93. Light emitting diodes (LEDs) 92 are mounted on a substrate 96 that is received in the space 93 and directly coupled to the conductive portion 91 by two terminals 961 extending from the substrate 96. A cover 94 is mounted to the base 90 and includes a plurality of heat dissipating openings 95. The heat generated by the lamp 9 is reduced by using the LEDs 92. However, the terminals 961 are at 180° to the substrate 96 such that the size of the substrate 96 received in the space 93 is limited.

SUMMARY OF THE INVENTION

An objective of the present invention is to provide a lamp holder that can be easily assembled.

Another objective of the present invention is to provide a lamp holder that can effectively dissipate heat generated by a lighting element held by the lamp holder.

The present invention fulfills the above objectives by providing, in a preferred form, a lamp holder including a heat dissipating seat having a compartment. A substrate is mounted in the compartment of the heat dissipating seat. The substrate includes a control circuit and at least one slot. At least one lighting element is adapted to be mounted in the at least one slot and in electrical connection with the control circuit. The substrate further includes two flexible terminals in electrical connection with the control circuit and the at least one slot. When mounting the lamp holder into a space of a base, the flexible terminals are inserted into two coupling holes in a conductive portion of an inner periphery of the space. The heat dissipating seat is then pressed downward for the resiliency of the flexible terminals to urge the heat dissipating seat into the space of the base, providing easy assembly.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
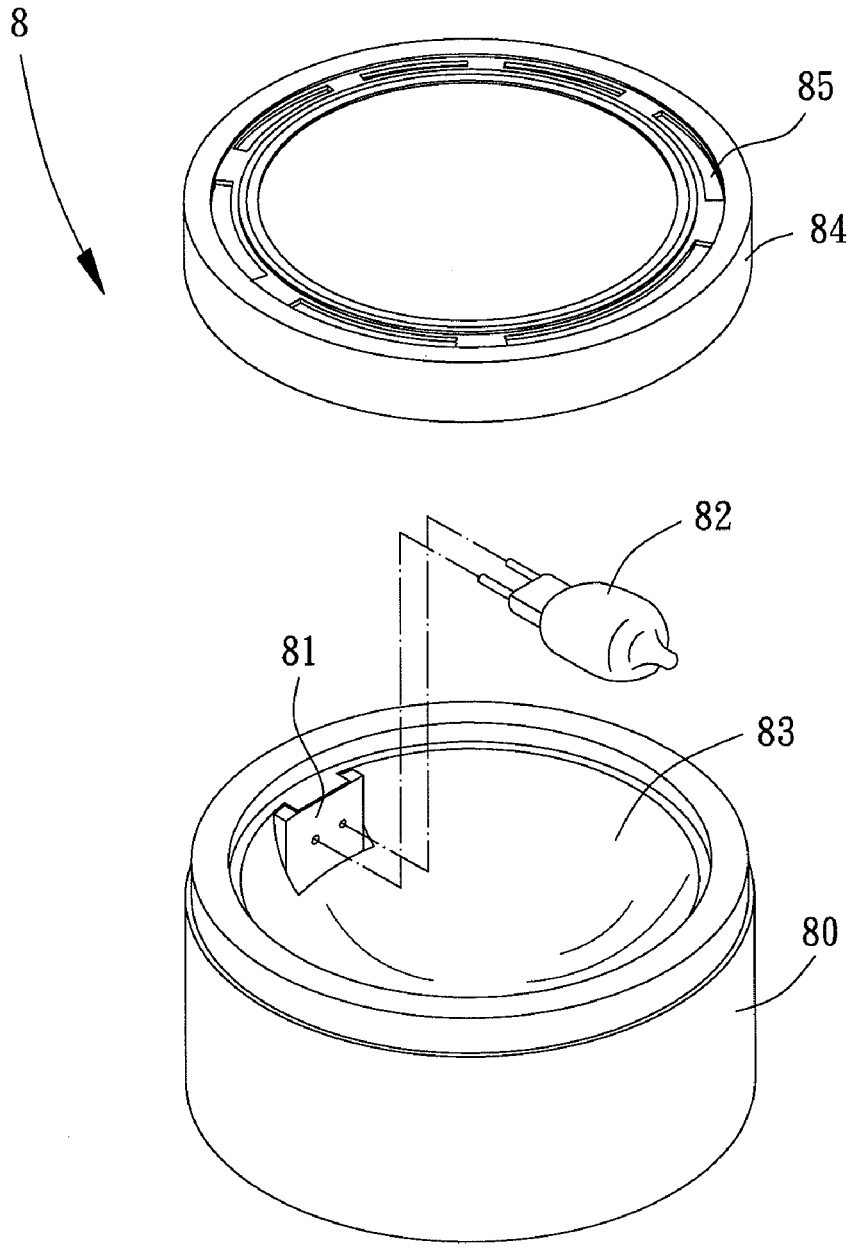
FIG. 1 PRIOR ART
FIG. 1 shows an exploded, perspective view of a conventional lamp.
Figure 2:
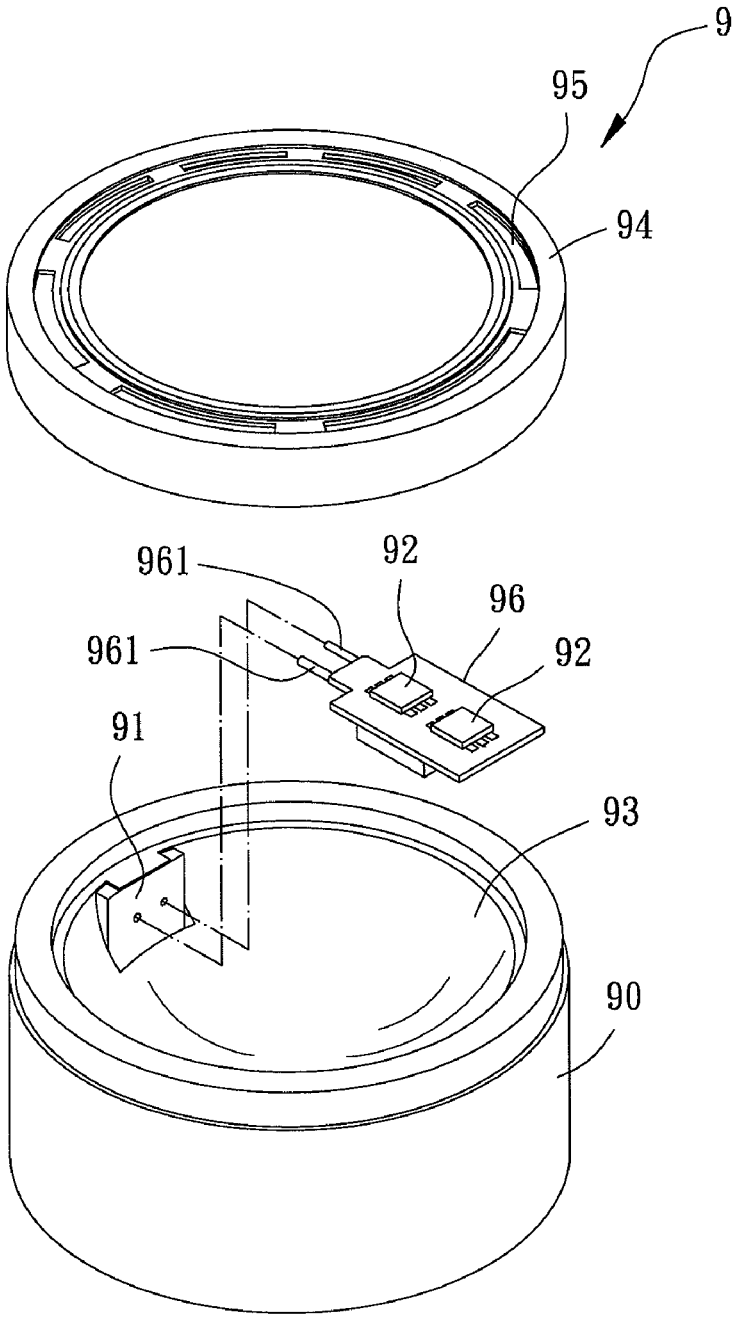
FIG. 2 PRIOR ART
FIG. 2 shows an exploded, perspective view of another conventional lamp.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "inner", "end", "portion", "section", "downward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 3:
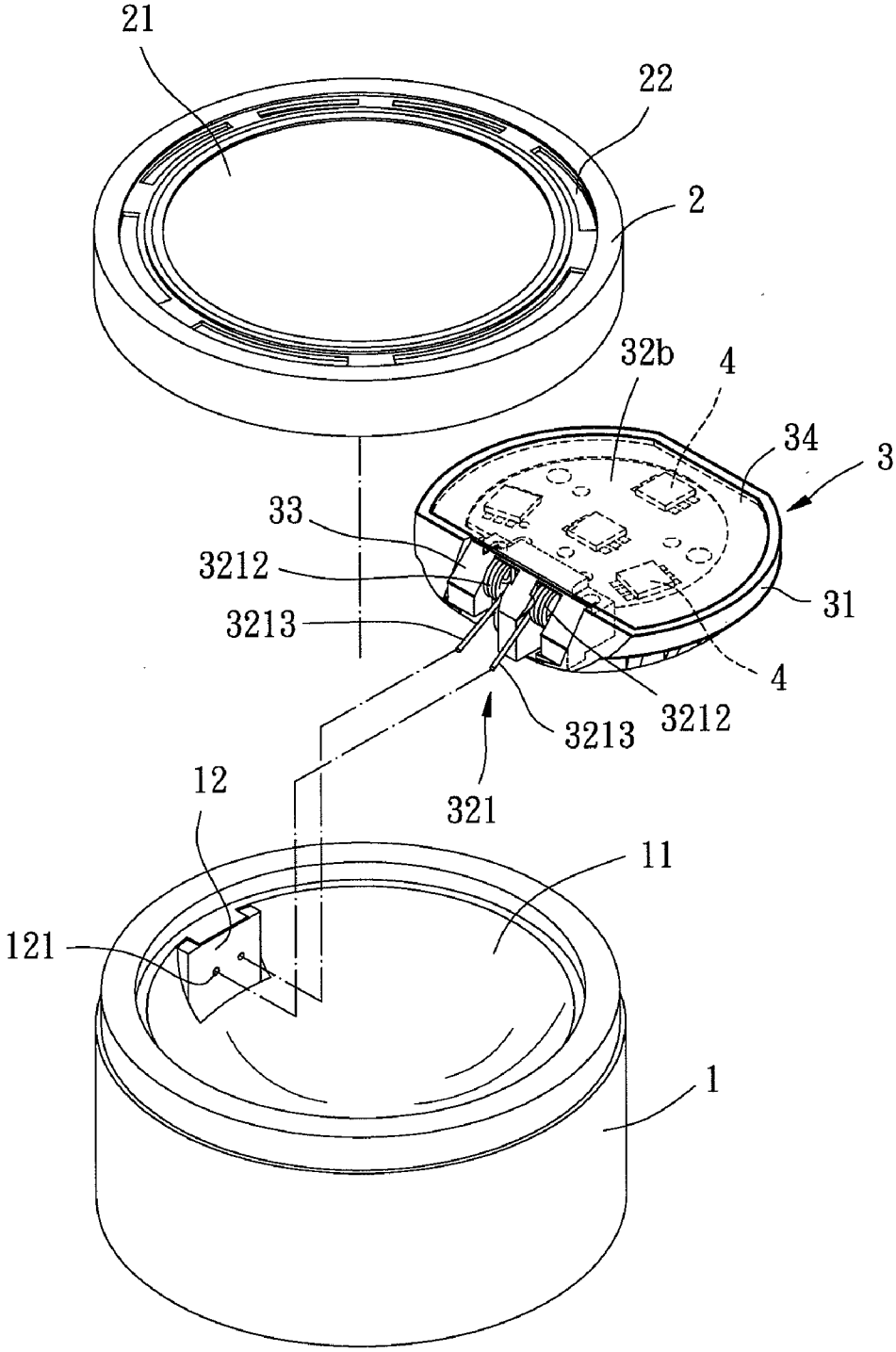
FIG. 3 shows an exploded, perspective view of a lamp device utilizing a lamp holder according to the preferred teachings of the present invention.

FIG. 3 shows a lamp device utilizing a lamp holder 3 according to the preferred teachings of the present invention. The lamp holder 3 is mounted in a base 1 and protected by a cover 2 that shields or is fixed to the base 1. The base 1 includes a space 11 in which the lamp holder 3 is received. A conductive portion 12 is provided on an inner periphery of the space 11 and includes two coupling holes 121 for electrical connection with the lamp holder 3. In the preferred form shown, the cover 2 includes a light transmitting layer 21 allowing transmission of light beams. The cover 2 further includes a plurality of heat dissipating openings 22 for dissipating heat from the lamp holder 3.

Figure 4:
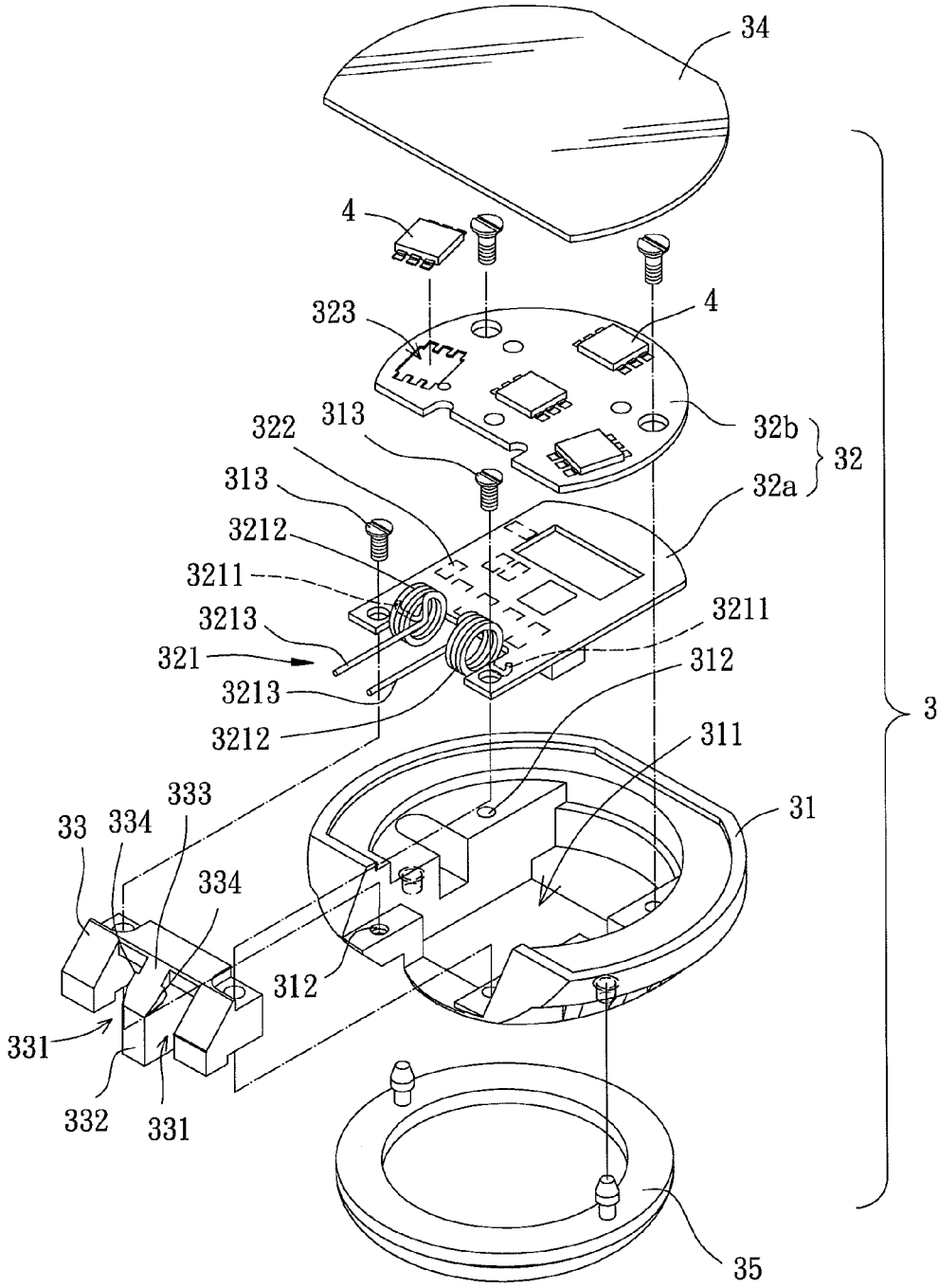
FIG. 4 shows an exploded, perspective view of the lamp holder of the lamp device of FIG. 3.

With reference to FIGS. 3 and 4, the lamp holder 3 includes a heat dissipating seat 31 and a substrate 32. The heat dissipating seat 31 is made of material with excellent heat dissipation characteristics, such as aluminum, copper, or alloy of magnesium and aluminum. The heat dissipating seat 31 includes a compartment 311 for receiving the substrate 32. The heat dissipating seat 31 includes a plurality of fixing holes 312, and fasteners 313 are extended through the substrate 32 into the fixing holes 312 to fix the substrate 32 in a desired location. The substrate 32 includes two terminals 321, a control circuit 322, and a plurality of slots 323. The terminals 321 are electrically connected to the control circuit 322 and the slots 323. In the preferred form shown, the substrate 32 includes a circuit board 32*a* and an electrically insulating board 32*b*, with the electrically insulating board 32*b* being arranged above the circuit board 32*a*. The terminals 321 and the control circuit 322 are mounted on the circuit board 32*a*, and the terminals 321 are electrically connected to the control circuit 322. Furthermore, the terminals 321 are flexible and each includes a positioning end 3211, a connection end 3213, and a resilient, flexible section 3212 between the positioning end 3211 and the connection end 3213. The positioning end 3211 is fixed to the circuit board 32*a*, and the connection end 3213 is a free end that can be inserted into and, thus, in electrical connection with one of the coupling holes 121 of the conductive portion 12. A preset, original angle between the circuit board 32*a* and the connection end 3213 of each terminal 321 is preferably in a range between 180° and 190°. In the preferred form shown, the angle between the circuit board 32*a* and the connection end 3213 of each terminal 321 is 190°. The resilient, flexible section 3212 between the positioning end 3211 and the connection end 3213 is in the form of a coil, allowing relative pivotal movement between the connection end 3213 and the circuit board 32*a*. A lighting element 4 is mounted in each slot 323 and electrically connected to the control circuit 322 for controlling on/off of the lighting element 4. The lighting elements 4 can be light-emitting diodes. It can be appreciated that the number of the slots 323 and the lighting elements 4 can be varied according to needs.

According to the preferred form shown, the lamp holder 3 further includes a pivotal seat 33 fixed by the fasteners 313 to a periphery of the heat dissipating seat 31. The pivotal seat 33 is preferably made of electrically insulating material and includes an opening 331 in communication with the compartment 311. The terminals 321 can extend out of the heat dissipating seat 31 via the opening 331. In the preferred form shown, the pivotal seat 33 includes a partitioning wall 332 that divides the opening 331 into two opening sections, and the terminals 321 can extend out of the heat dissipating seat 31 via the opening sections, respectively. The partitioning wall 332 prevents short circuit resulting from undesired contact between the terminals 321. In the preferred form shown, the partitioning wall 332 further includes a reduced section 333 with two stop portions 334 respectively facing the opening sections. The terminals 321 can be retained at the stop portions 334 when the terminals 321 are pivoted relative to the control circuit 32*a* (see FIG. 6).

According to the preferred form shown, the lamp holder 3 further includes a protective layer 34 and a heat conducting layer 35. The protective layer 34 can shield or be fixed on a top of the heat dissipating seat 31 by any suitable provision such as screwing and male/female coupling. The protective layer 34 is preferably made of light transmittable material. The heat conducting layer 35 is fixed to a bottom of the heat dissipating seat 31 and preferably made of electrically insulating and heat conducting material. After the lamp holder 3 is mounted in the space 11 of the base 1, the heat conducting layer 35 is in surface contact with the inner periphery of the space 11 such that the heat generated by the lighting elements 4 can be transmitted through the heat conducting layer 35 to the base 1 and then dissipated to the environment. The heat conducting layer 35 made of electrically insulating material avoids short circuit as well as other risks.

Figure 5:
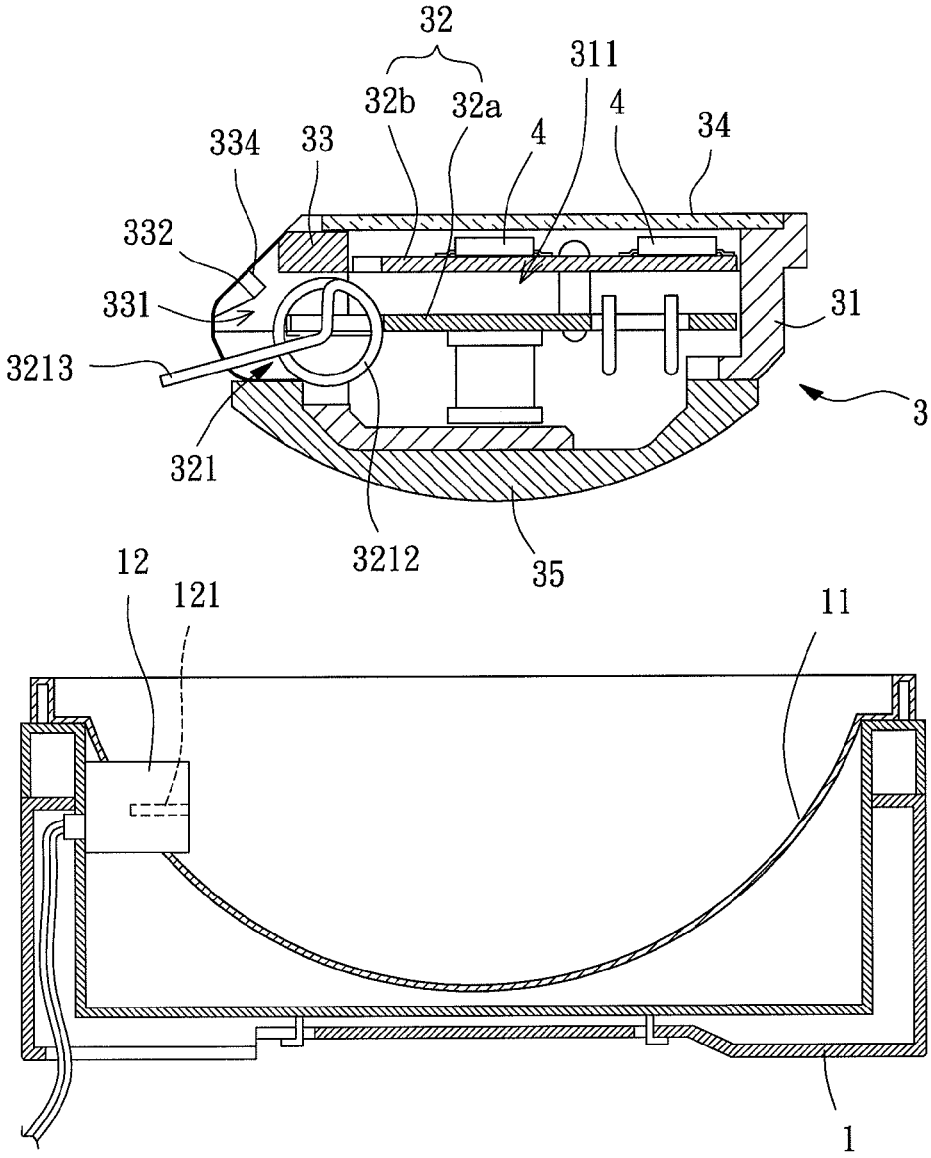
FIG. 5 shows an exploded, cross sectional view of the lamp device of FIG. 3 with the lamp holder not engaged with a base of the lamp device.
Figure 6:
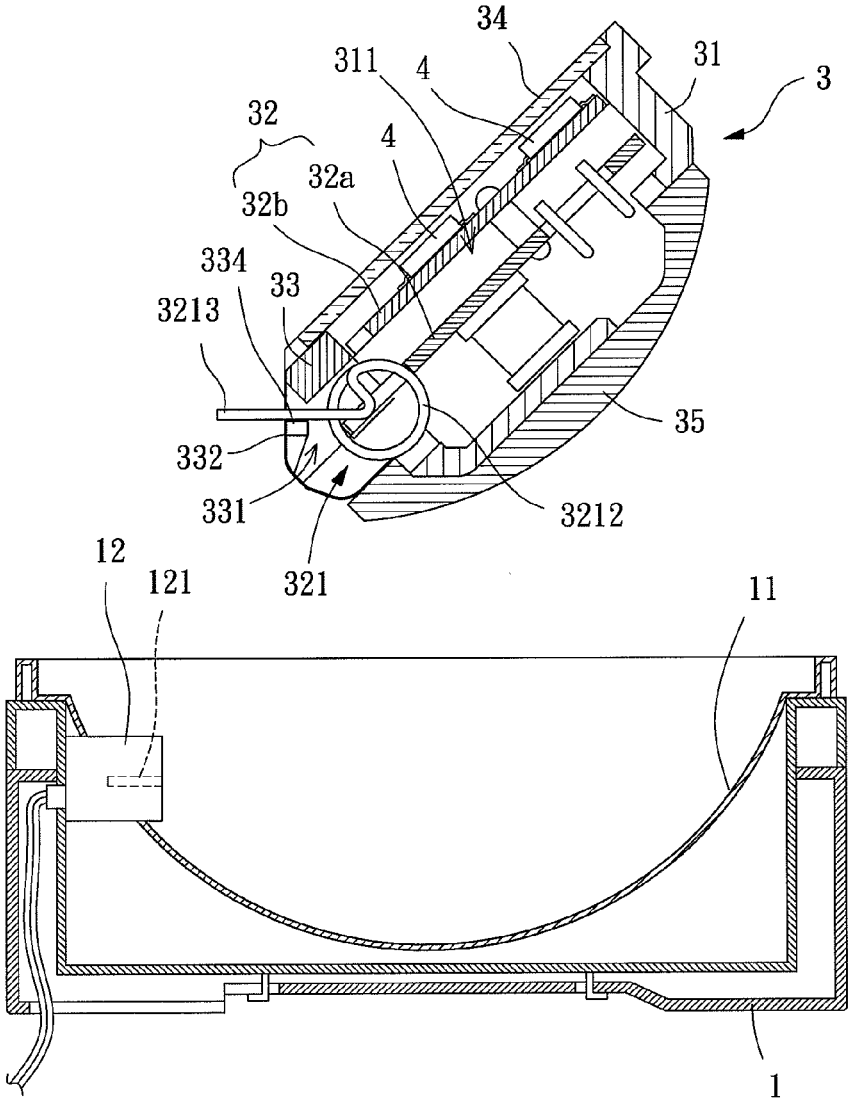
FIG. 6 shows an exploded, cross sectional view of the lamp device of FIG. 3 with the lamp holder rotated through an angle.

With reference to FIGS. 5 and 6, in assembly of the lamp holder 3 according to the preferred teachings of the present invention into the space 11 of the base 1, the terminals 321 of the lamp holder 3 are pivoted relative to the circuit board 32*a* until the terminals 321 are retained at the stop portions 334. At this time, the connection end 3213 of each terminal 321 is at an angle in a range between 120° and 160° to the circuit board 32*a* such that the heat dissipating seat 31 is slant relative to the connection end 3213 to allow easy insertion of the terminals 321 into the coupling holes 121 of the conductive portion 12.

Figure 7:
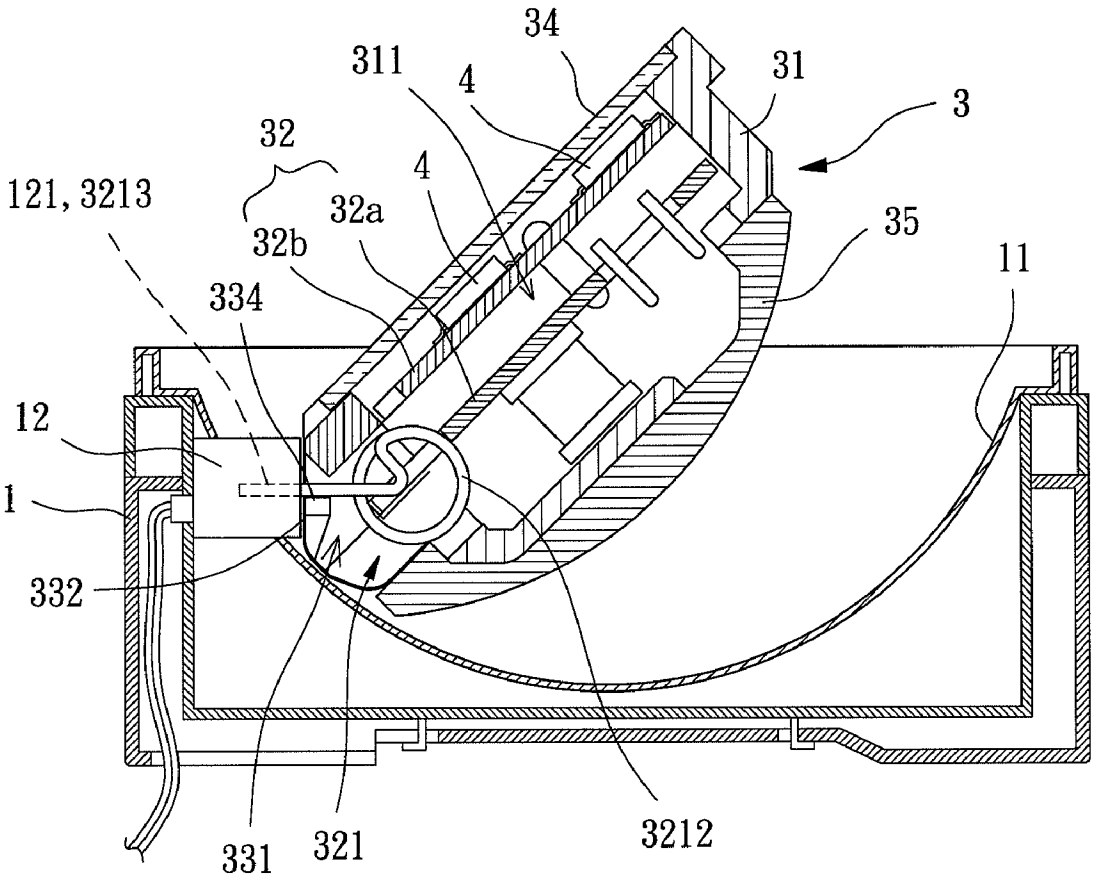
FIG. 7 shows an exploded, cross sectional view of the lamp device of FIG. 3 with the lamp holder inserted into the base.
Figure 8:
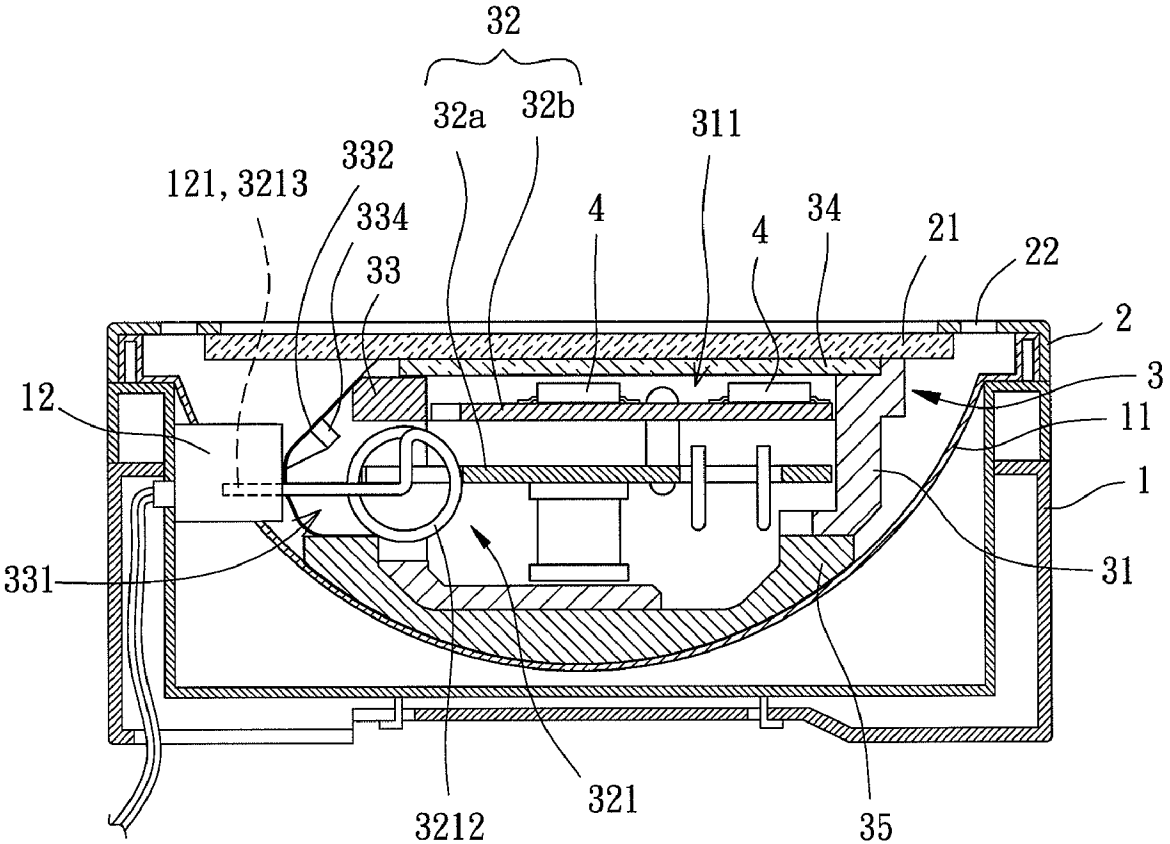
FIG. 8 shows a cross sectional view of the lamp device of FIG. 3 after assembly.

With reference to FIGS. 7 and 8, when the heat dissipating seat 31 is subjected to downward pressing force after the terminals 321 are inserted into the coupling holes 121 of the base 1, the terminals 321 are apt to disengage from the stop portions 334 due to flexibility of the terminals 321. Thus, the whole lamp holder 3 is moved into and completely received in the space 11 due to relative pivotal movement between the circuit board 32*a* and the terminals 321. Since the preset, original angle between the connection ends 3213 and the circuit board 32*a* is 190°, the resiliency of the terminals 321 urges the heat dissipating seat 31 to press against the bottom of the space 11 after the connection ends 3213 disengage from the stop portions 334. Thus, the heat conducting layer 35 is in intimate surface contact with the bottom of the space 11 such that the heat generated by the lamp holder 3 can be directly transmitted through the heat conducting layer 35 to the base 1 and then dissipated to the environment.

The lamp holder 3 according to the preferred teachings of the present invention can be easily assembled by utilizing the pivotable terminals 321. Furthermore, the lamp holder 3 received in the space 11 of the base 1 can be of a larger size by using the pivotable terminals 321. Further, the bottom of the heat dissipating seat 31 of the larger size can be in direct surface contact with the inner periphery of the space 11, increasing the area of heat exchange. Thus, the heat generated by the lamp holder 3 can be directly transmitted through the heat conducting layer 35 to the base 1 and then dissipated to the environment, providing enhanced heat dissipating effect.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A lamp holder comprising:

a heat dissipating seat including a compartment; and a substrate mounted in the compartment of the heat dissipating seat, with the substrate including a control circuit and at least one slot, with at least one lighting element adapted to be mounted in said at least one slot and in electrical connection with the control circuit, with the substrate further including two flexible terminals in electrical connection with the control circuit and said at least one slot.

2. The lamp holder as claimed in claim 1, with the heat dissipating seat adapted to be mounted in a space of a base, with the base including a conductive portion on an inner periphery of the space, with the conductive portion having two coupling holes, with the two terminals adapted to be inserted into and in electrical connection with the two coupling holes.

3. The lamp holder as claimed in claim 1, further comprising: a pivotal seat mounted to a periphery of the heat dissipating seat, with the pivotal seat including an opening, with the two terminals extending out of the heat dissipating seat via the opening.

4. The lamp holder as claimed in claim 3, with the pivotal seat including a partitioning wall dividing the opening into two opening sections, with the two terminals respectively extending out of the heat dissipating seat via the two opening sections.

5. The lamp holder as claimed in claim 4, with the partitioning wall including a reduced section having two stop portions respectively facing the two opening sections, with the two terminals retainable at the two stop portions.

6. The lamp holder as claimed in claim 1, with the substrate including a circuit board and an electrically insulating board, with the control circuit and the two terminals mounted on the circuit board, with the electrically insulating board including said at least one slot, with said at last one slot electrically connected to the control circuit and the two terminals.

7. The lamp holder as claimed in claim 1, with each of the two terminals including a positioning end, a connection end, and a resilient, flexible section between the positioning end and the connection end, with the positioning end fixed to the substrate, with the connection end being a free end.

8. The lamp holder as claimed in claim 1, further comprising: a protective layer made of light transmittable material, with the protective layer shielding or fixed to a top of the heat dissipating seat.

9. The lamp holder as claimed in claim 1, further comprising: a heat conducting layer on a bottom of the heat dissipating seat, with the heat conducting layer made of electrically insulating and heat conducting material.

10. The lamp holder as claimed in claim 2, further comprising: a heat conducting layer on a bottom of the heat dissipating seat, with the heat conducting layer made of electrically insulating and heat conducting material, with the heat conducting layer in surface contact with the inner periphery of the space of the base when the heat dissipating seat is received in the space of the base.

11. The lamp holder as claimed in claim 7, with the resilient, flexible section of each of the two terminals being in the form of a coil allowing pivotal movement between the circuit board and the connection end of each of the two terminals.

* * * * *